US005915311A

United States Patent [19]

Müller et al.

[11] Patent Number: 5,915,311

[45] Date of Patent: Jun. 29, 1999

[54] PROCESS FOR THE THERMAL TREATMENT OF WASTE MATERIAL

[75] Inventors: Patrick Müller, Schaffhausen; Hans Rüegg, Wohlen, both of Switzerland

[73] Assignee: Von Roll Umwelttechnik AG, Zurich, Switzerland

[21] Appl. No.: 08/702,551

[22] PCT Filed: Jan. 8, 1996

[86] PCT No.: PCT/CH96/00007

§ 371 Date: Oct. 24, 1996

§ 102(e) Date: Oct. 24, 1996

[87] PCT Pub. No.: WO96/21824

PCT Pub. Date: Jul. 18, 1996

[30] Foreign Application Priority Data

Jan. 10, 1995 [CH] Switzerland ..... 00 053/95

[51] Int. Cl.[6] ..... F23J 11/00

[52] U.S. Cl. ..... 110/345; 110/229; 110/245; 110/348

[58] Field of Search ..... 110/234, 245, 110/345, 229, 230, 210, 211, 212, 214, 216, 348

[56] References Cited

U.S. PATENT DOCUMENTS

| | | | |
|---|---|---|---|
| 4,325,327 | 4/1982 | Kantesaria et al. | 110/245 X |
| 4,541,345 | 9/1985 | Grumpelt et al. | 110/229 |
| 4,602,573 | 7/1986 | Tanca | 110/229 X |
| 5,170,725 | 12/1992 | Sass et al. | 110/229 X |
| 5,347,953 | 9/1994 | Adbulally | 110/245 X |
| 5,370,067 | 12/1994 | Finet | 110/234 X |
| 5,651,321 | 7/1997 | Siniakevith et al. | 110/229 X |
| 5,669,317 | 9/1997 | May et al. | 110/229 |

FOREIGN PATENT DOCUMENTS

WO 95/00804 1/1995 WIPO .

*Primary Examiner*—Henry Bennett
*Assistant Examiner*—Susanne C. Tinker
*Attorney, Agent, or Firm*—Oblon, Spivak, McClelland, Maier & Neustadt, P.C.

[57] ABSTRACT

The waste material is degasified under the action of heat in a pyrolysis chamber (2). The volatile degasifying products are subjected to afterburning with supply of oxygen in an afterburning chamber (4*a* or 4*b* or 4*c*) designed as a fluidized-bed reactor. The solids discharged from the afterburning chamber (4*a* or 4*b* or 4*c*) are separated off from the flue gas stream in a dust separator (8) and, preferably cooled in an external fluid-bed cooler, are recycled to the afterburning chamber (4*a* or 4*b* or 4*c*). The temperatures of above 2500° C., which are produced in the afterburning of the carbonization gases having a high heating value (minimum 8000 kJ/m$^3$ (S.T.P.), can be controlled.

10 Claims, 3 Drawing Sheets

PROCESS FOR THE THERMAL TREATMENT OF WASTE MATERIAL

The invention relates to a process for the thermal treatment of waste material with production of thermal energy in accordance with the preamble of claim 1.

Degasifying as a thermal process for energy production from waste, also termed pyrolysis, low-temperature carbonization or coking, is known (cf. in this context the specialist journal Müll und Abfall 12/1978 or Swiss Patent Application No. 01 510/94-8, A 10364 CH). In all processes based on degasifying, the waste is heated in the absence of oxygen by direct or indirect supply of heat. During this heating the organic compounds in the waste become unstable; the volatile constituents escape, and the non-volatile constituents are converted into coke.

The low-temperature carbonization gases produced in the degasifying have a high heating value. When these low-temperature carbonization gases are directly burnt in conventional afterburning chambers with oxygen or oxygen-enriched air, very high temperatures of above 2000° C. result, which are difficult to control.

The object underlying the present invention is to create a process of the type mentioned at the outset which enables control of the temperature profile in the afterburning.

This object is achieved according to the invention by the features specified in the characterizing part of claim 1.

DE-A 33 07 848 discloses reburning and cleaning metallurgical process off-gases containing combustible constituents in a circulating fluidized bed, the process off-gases and oxygen-containing gases being introduced separately into the fluidized-bed reactor and being reburnt and simultaneously cleaned therein in the presence of solids containing gas-cleaning agents. The process off-gases used have a low heating value.

WO-A-93/18341 discloses burning homogeneous fuels such as coal, oil or petroleum coke in two separate stages. The combustion proceeds in these two stages with supply of oxygen. In order to burn solids which are not burnt in the first stage, i.e. carbon and gases, an oxygen excess is used in the second stage.

The process of the invention relates to the pyrolysis of waste, in particular refuse, in which, as mentioned above, very high temperatures result in the afterburning with oxygen; by means of the afterburning according to the invention in a circulating fluidized bed, optimum and uniform reaction conditions are created for the afterburning, since a very homogeneous temperature distribution is achieved. At the same time, a highly efficient cooling of the hot carbonization gases is achieved. The gas-solids flow present in the fluidized bed gives a very good heat transfer, which leads to a diminution of the heat-transfer surfaces and thus also of the boiler size. The reduction in the amount of flue gas achieved by the afterburning with oxygen also causes a decrease in the size of the fluidized-bed reactor and the downstream equipment, an increase in boiler efficiency, a reduction in expenditure for gas cleaning and a reduced risk of corrosion of the heat-transfer surfaces.

A problem in the thermal treatment of waste is the formation of nitrogen oxides. For reasons of environmental protection, these cannot be freely released into the surroundings. A number of processes have previously been disclosed, for example the SNCR process (Selective Noncatalytic Reduction Process), see U.S. Pat. No. 3,970,739, in which nitrogen oxides in flue gases are reduced to nitrogen by spraying-in an ammonia solution, or other suitable reducing agents, in the presence of the oxygen present in any case.

The ammonia for this purpose is customarily introduced into the flue gas stream at a suitable point. The flue gas temperature at this point of introduction plays an important role. It must lie between 700° and 1100° C. If the flue gas temperature is too low, a great ammonia excess is required. The unreacted ammonia in the flue gas is termed slip and represents environmental pollution. If the temperature is too high, some of the ammonia burns. In both cases, the amount of ammonia needed is unnecessarily high. Along the flue gas path through the afterburning chamber and boiler, the temperature of the flue gases continuously decreases. The ammonia is introduced at the point of optimum flue gas temperature. However, this poses the problem that the flue gas temperature profile depends on the operating state of the plant and on the waste material incinerated. This means that the position of the optimum point of introduction also depends on the operating state of the furnace.

The design of the afterburning chamber as a circulating fluidized bed provides a solution to the problem of selection of the point of introduction of ammonia for the flue gas formation. The circulating fluidized bed, in addition to its temperature constancy, is also distinguished by good temperature control behaviour. Thus, for example, the solids flow rate diverted into the fluid-bed cooler can be controlled. This permits a control of the heat flow rate also removed from the afterburning chamber and thus a precise control of the temperature in the afterburning chamber independently of the operating state of the furnace in the pyrolysis chamber. As a result, a fixed point of ammonia introduction can be selected, since the flue gas temperature profile in the afterburning chamber and boiler no longer depends on the operating state of the furnace. This additionally enables the consumption of ammonia for nitrogen oxide decrease to be minimized by selecting an optimum temperature in the afterburning chamber, independently of the operating state in the pyrolysis chamber.

The invention is now described in more detail with reference to the drawing. Three variants of the process of the invention are represented in the drawing and are described in more detail below.

Figure 1:
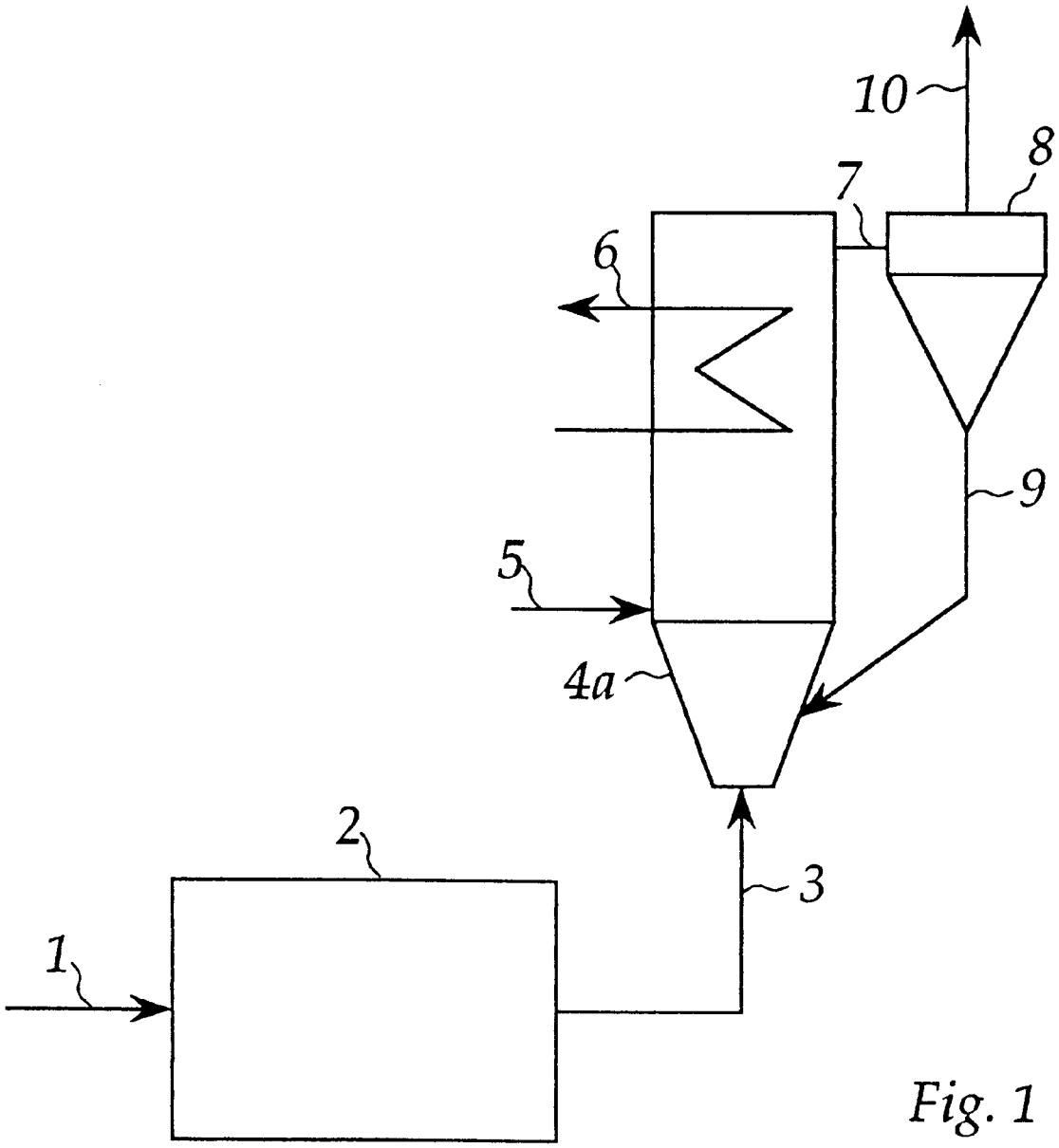
FIG. 1 shows a flow diagram of a first process variant.

According to FIG. 1, waste materials are subjected to a degasifying in a pyrolysis chamber 2 in a manner known per se and not shown in detail. The waste feed is indicated by an arrow 1. The waste feed and the degasifying can be performed, for example, in the manner described in Swiss Patent Application No. 01 510/94-8 (A 10364 CH). Carbonization gases formed in the degasifying enter an afterburning chamber 4*a* (the transfer from pyrolysis chamber 2 to the afterburning chamber 4*a* is indicated by an arrow 3), which, according to the invention, is designed as a fluidized-bed reactor. In the afterburning chamber 4*a*, the carbonization gases used as fluidizing gases are subjected to afterburning with supply of oxygen (in FIG. 1, indicated by arrow 5). As fluidized bed solids, use can be made of lime, sand and other materials; preferably, refuse coke produced in the pyrolysis—freed of inert substances and finely ground—can also be introduced in particle form into the fluidized bed and there burnt in conjunction.

The walls of the afterburning chamber 4*a* are designed as cooling surfaces or heat-transfer surfaces; further heat-transfer surfaces, if necessary, can be arranged directly in the fluidized bed. These heat-transfer surfaces are designated in FIG. 1 by the symbol 6.

The fluidized-bed reactor is operated at a gas velocity sufficiently high that at least some of the solids particles are discharged from the afterburning chamber 4*a* together with the flue gas stream. Having arrived via a line 7 in a dust separator 8, the solids are separated from the flue gas stream. The dust separator 8 can be designed, for example, as a cyclone, a dust filter or as an electrostatic precipitator. Solids removed are recycled via a line 9 to the afterburning chamber 4*a*, so that a circulating fluidized-bed is formed. The flue gases freed from solids and cooled flow via a line 10 to further flue gas cleaning or flue gas cooling devices, which are not shown, before they pass into the atmosphere.

Figure 2:
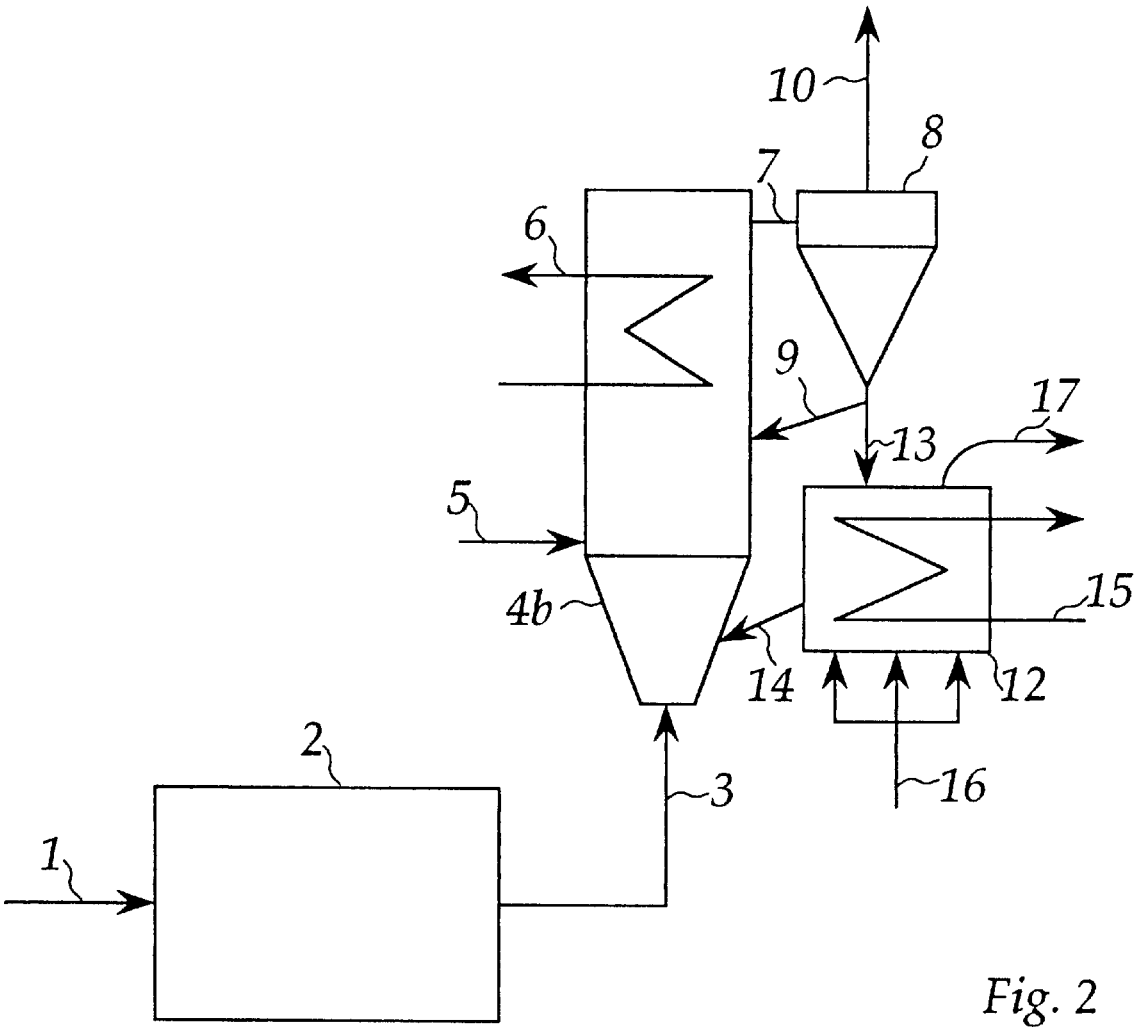
FIG. 2 shows a flow diagram of a second process variant.

According to FIG. 2, in which the parts of the flow diagram which are known from FIG. 1 and remain identical are designated by the identical reference numbers, the circulating fluidized bed is extended by an external fluid-bed cooler 12. This permits some of the heat removal to be moved out of the afterburning chamber 4*b*. Some of the solids separated off in the dust separator 8 are diverted via line 13 to the fluid-bed cooler 12, where they are cooled in a fixed fluidized bed (fluid bed) by direct or indirect heat transfer (corresponding heat-transfer surfaces of the fluid-bed cooler 12 are designated by the symbol 15) and then passed back to the afterburning chamber 4*b* via a line 14. In the afterburning chamber 4*b*, these solids absorb the heat from the hot carbonization gases and heat up to the mixing temperature prevailing in the afterburning chamber 4*b*. In this variant, the additional cooling surfaces in the afterburning chamber 4*b* can be omitted, since the recirculated portion of the solids cooled in the fluid-bed cooler 12 takes over the cooling function.

A fluidizing gas necessary for operating the fluid-bed cooler 12 is fed to the fluid-bed cooler 12 via a line 16 and is taken off again (line 17) above the fluid bed for a further use.

Figure 3:
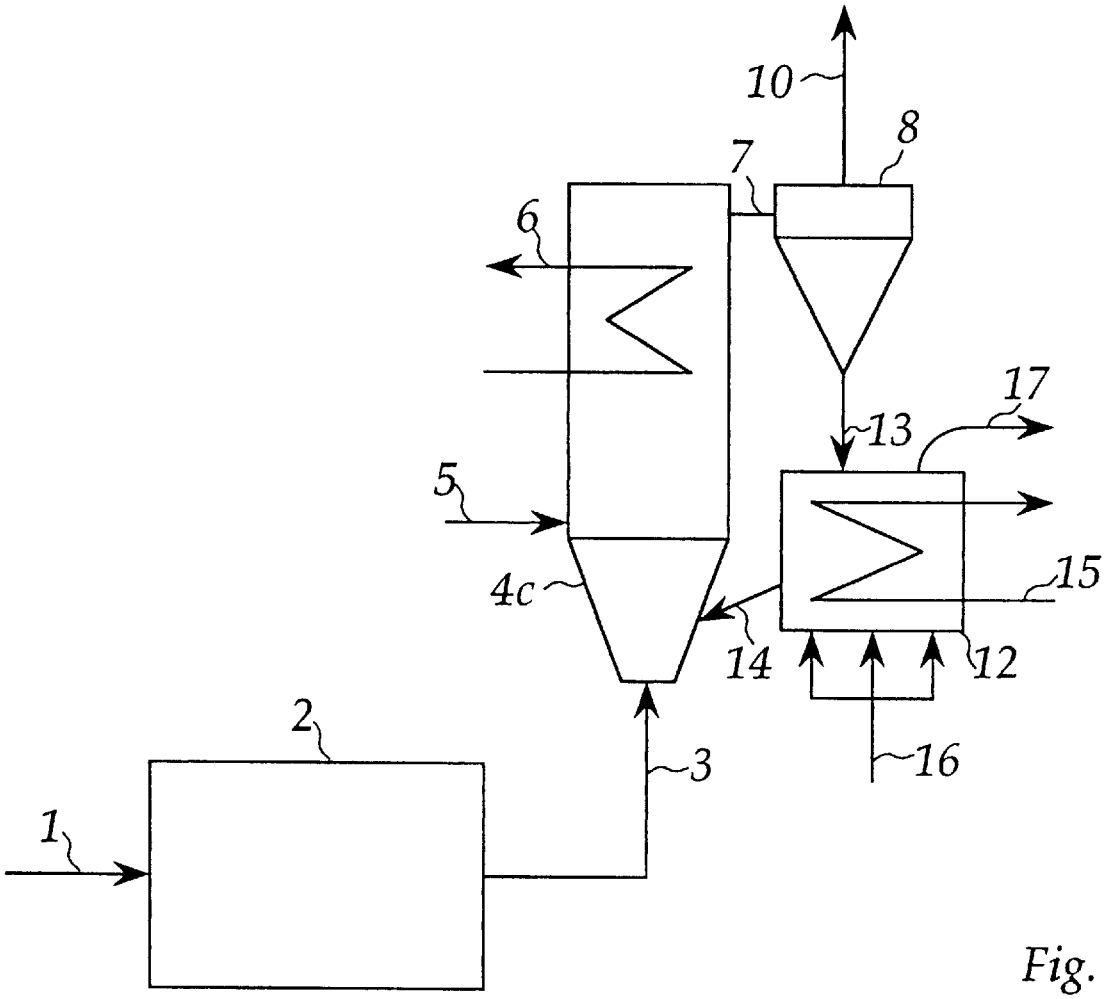
FIG. 3 shows a flow diagram of a third process variant.

In the variant depicted in FIG. 3, all of the solids separated off from the flue gas stream in the dust separator 8 are passed through the fluid-bed cooler 12 and, having been cooled, are recirculated to the fluidized-bed of the afterburning chamber 4*c*.

By transferring to the fluid-bed cooler 12 (FIGS. 2 and 3) the heat-transfer surfaces otherwise most seriously affected by corrosion phenomena, a great decrease in boiler corrosion is achieved. In the fluid-bed cooler 12, the heat-transfer surfaces 15 are less exposed to corrosion, since the highly corrosive flue gases are not used at all here.

In the process variants depicted in FIGS. 2 and 3, a large amount of cooled solids are introduced into the fluidized bed, in order that the afterburning of the carbonization gases can be carried out at a low temperature level of approximately 900° C.; the average suspension density is at least 20–50 kg/m$^3$ (S.T.P.). If the fluid-bed cooler 12 is omitted (variant according to FIG. 1), the suspension density of the gas/solids mixture must be selected to be considerably higher still, e.g. 50–100 kg/m$^3$ (S.T.P.), in order to ensure sufficient heat transfer to the fluidized-bed reactor walls, which are designed as a boiler.

In the process variants depicted in FIGS. 2 and 3, the temperature in the afterburning chamber 4*b* or 4*c* can be precisely controlled independently of the operating state in the pyrolysis chamber 2, by controlling the input of the solids cooled in the fluid-bed cooler 12. This permits ammonia to be introduced optimally into the afterburning chamber 4*b* or 4*c* or into the dust separator 8 or cyclone as reducing agent for nitrogen oxide removal, and permits the temperature to be chosen so that the nitrogen oxide removal can be carried out with minimal ammonia consumption. Preferably, the ammonia is introduced into the cyclone intake.

We claim:

1. A process for the thermal treatment of waste material comprising:

pyrolizing said waste material to produce a solid product comprising combustible coke and a volatile product comprising combustible gases;

burning said volatile product with a supply of oxygen in a circulating fluidized bed reactor to produce a flue gas in the presence of fluidized solids;

separating said solids from said flue gas; and returning said solids to said fluidized bed;

wherein an average suspension density of a gas/solid mixture in said fluidized bed is at least 50–100 kg/m$^3$ (S.T.P.).

2. The process according to claim 1, wherein at least some of the solids discharged from the fluidized bed reactor are cooled in an external fluid-bed cooler with heat recovery and are returned to the fluidized bed reactor.

3. The process according to claim 2, wherein the average suspension density of the gas/solids mixture in the fluidized bed reactor is at least 20–50 kg/M$^3$ (S.T.P.).

4. The process according to claim 1, wherein said solid product is freed of inert substances, finely ground, and burnt in conjunction in the fluidized bed reactor.

5. The process according to claim 1, wherein a reducing agent is introduced into the fluidized bed reactor for nitrogen oxide elimination.

6. The process according to claim 1, wherein a reducing agent is introduced for nitrogen oxide elimination downstream of where said flue gas is released from said fluidized bed reactor.

7. An apparatus for thermal treatment of waste material comprising a pyrolysis chamber and a fluidized bed reactor connected to the pyrolysis chamber, wherein the fluidized bed reactor is also connected to a dust separator.

8. Apparatus according to claim 7, wherein walls of the fluidized-bed reactor are designed as heat-transfer surfaces.

9. The apparatus according to claim 7, wherein an external fluid-bed cooler is connected to said fluidized bed reactor and said dust separator.

10. A process for the thermal treatment of waste material comprising:

pyrolyzing said waste material to produce a solid product comprising combustible coke and a volatile product comprising combustible gases;

burning said solid product and said volatile product with oxygen in a circulating fluidized bed reactor to produce a flue gas comprising solids;

separating said solids from said flue gas; and returning said solids to said fluidized bed for continued burning, wherein said solid product is freed of inert substances and finely ground before burning in said fluidized bed reactor.

* * * * *